US005913694A

United States Patent [19]

Wright

[11] Patent Number: 5,913,694

[45] Date of Patent: Jun. 22, 1999

[54] CONNECTOR ASSEMBLY

[75] Inventor: John O. Wright, York, Pa.

[73] Assignee: Osram Sylvania Inc., Danvers, Mass.

[21] Appl. No.: 08/972,521

[22] Filed: Nov. 18, 1997

[51] Int. Cl.[6] ..... H01R 17/04

[52] U.S. Cl. ..... 439/394; 439/578

[58] Field of Search ..... 439/610, 609, 439/608, 607, 98, 99, 100, 578, 584, 394, 274, 275

[56] References Cited

U.S. PATENT DOCUMENTS 3,977,752 8/1976 Freitag ..... 439/411
5,562,506 10/1996 Wright ..... 439/675

*Primary Examiner*—Gary Paumen
*Assistant Examiner*—Alexander Gilman
*Attorney, Agent, or Firm*—William H. McNeill

[57] ABSTRACT

A connector assembly useful in grounding applications is provided which includes an insulative housing and a conductive ground shell. The insulative housing includes a passage into which a contact and a cable may be inserted, and a passage which provides access to an inserted contact and cable to facilitate electrical and mechanical connection thereof. Passages in the insulative housing are also provided for inserting legs of the conductive ground shell into the insulative housing to electrically engage the ground wire braid of the cable. The insulative housing and conductive ground shell are constructed and arranged so that the various components readily mate with one another.

10 Claims, 3 Drawing Sheets

CONNECTOR ASSEMBLY

TECHNICAL FIELD

The present invention relates to a connector assembly for use with a coaxial cable. More particularly, the present invention relates to such a connector assembly which is useful, without limitation, with conventional antenna connectors such as those used in the automobile industry for radios.

BACKGROUND ART

In many applications involving the use of a coaxial cable it is known to strip one or both ends of the cable to expose a length of the center conductor. Typically, a length of ground wire braid is then folded back upon the cable. In some instances, a metal sleeve is crimped to the outer peripheral PVC surface or jacket of the coaxial cable adjacent the stripped end and the ground wire braid is folded back upon such metal sleeve. A metal shell may also be provided adjacent the stripped end, the ground wire braid being sandwiched between the metal sleeve and the metal shell. Cables dressed in this manner are used, for example, with conventional antenna connectors such as those used in the automobile industry for radios. In such uses, each end of a coaxial cable prepared in this manner may have a respective connector such as a male or female connector mechanically and electrically attached thereto. It is known that if the ground wire braid is not dressed properly there may be a tendency for unsatisfactory grounding. Such unsatisfactory grounding may occur immediately during use of the antenna cable or be intermittent in nature and occur sometime in the future.

DISCLOSURE OF THE INVENTION

It is an object of the present invention to provide an improved connector assembly for use with a cable.

It is yet another object of the present invention to provide an improved connector assembly which can be attached to the end of a coaxial cable to conductively engage the cable ground wire braid without the need to remove a portion of the jacket of the cable to expose a length of ground wire.

It is another object of the present invention to provide an improved connector assembly for use with an antenna cable.

Yet another object of the present invention is to provide an improved connector assembly which is less costly than those fabricated heretofore.

It is yet another object of the present invention to provide a connector assembly which includes readily alienable components for ease of assembly thereof.

A further object of the present invention is to provide an improved method of grounding a cable.

This invention achieves these and other objects by providing a connector assembly which comprises an insulative housing and a conductive ground shell. The insulative housing extends in the direction of a housing longitudinal axis from a first length to a second length and includes (a) a first passage constructed and arranged to contain at least a portion of a contact and a section of cable, comprising a ground wire braid and adapted to be connected to the contact, (b) at least one second passage extending from an outer periphery of the insulative housing to such first passage; and (c) a channel in the outer periphery of the insulative housing. The conductive ground shell extends in the direction of a ground shell longitudinal axis from a first end to a second end and is constructed and arranged to mate with the insulative housing. The conductive ground shell includes at least one leg insertable into a respective second passage of the insulative housing, such leg being bendable towards and away from the first passage for engaging and disengaging a ground wire braid, respectively. The conductive ground shell further includes a region constructed and arranged to mate with the channel of the insulative housing. A method of grounding a cable is also disclosed.

BRIEF DESCRIPTION OF THE DRAWINGS

This invention may be clearly understood by reference to the attached drawings wherein like parts are designated by like reference numerals and in which.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
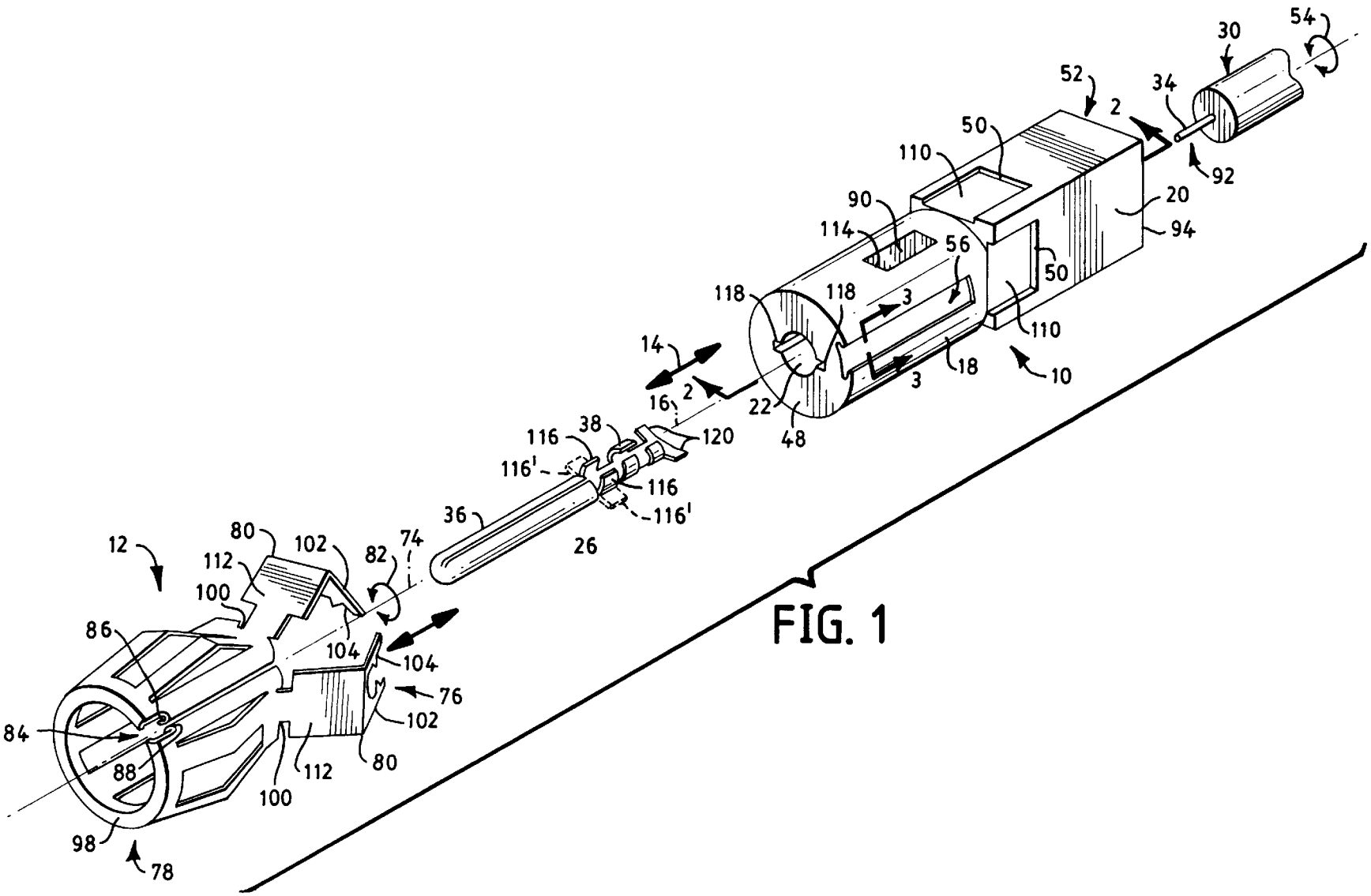
FIG. 1 is an exploded view of a connector assembly embodying the present invention.
Figure 2:
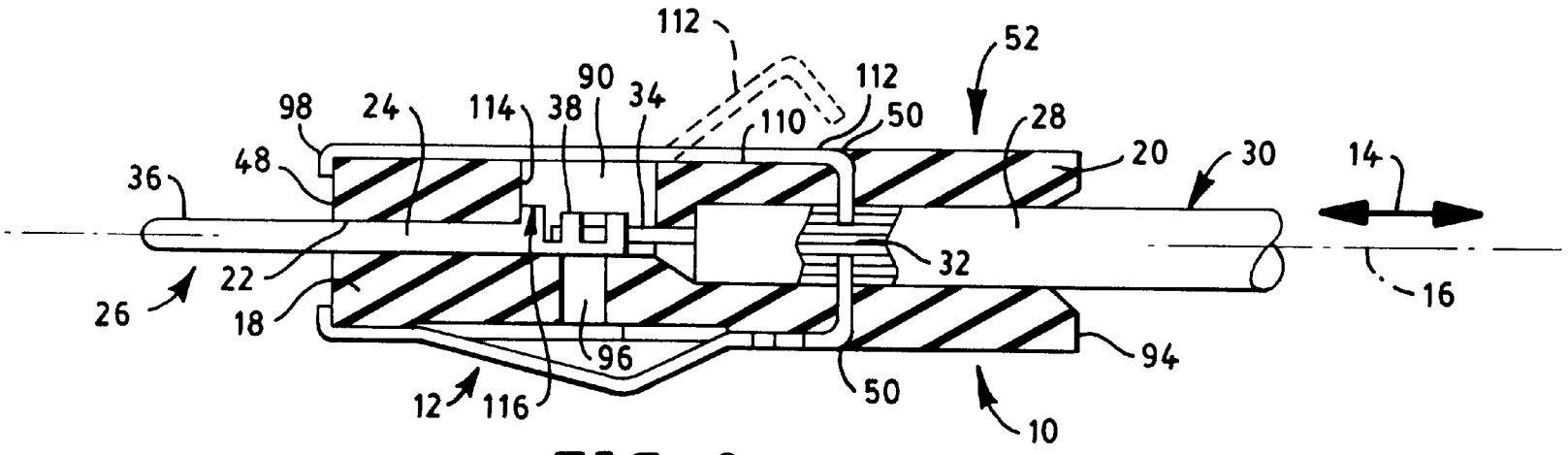
FIG. 2 is a cross section of the assembled connector assembly of FIG. 1 taken along lines 2—2.
Figure 3:
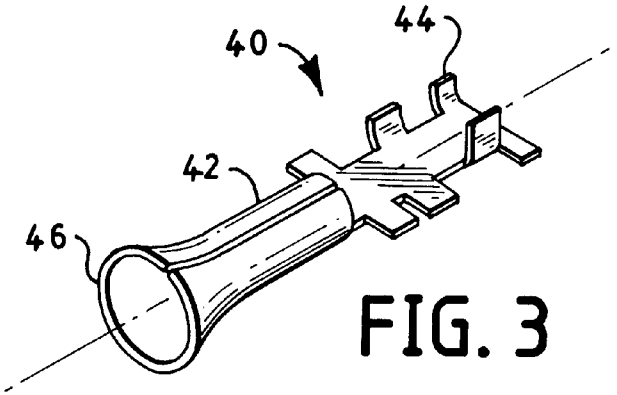
FIG. 3 is a perspective view of a female contact of the present invention.

The embodiment of this invention which is illustrated in the drawings is one which is particularly suited for achieving the objects of this invention. The connector assembly of the present invention includes an insulative housing and a conductive ground shell constructed and arranged to mate with the insulative housing. By way of illustration, FIG. 1 depicts an insulative housing 10 and a conductive ground shell 12. Insulative housing 10 extends in the direction 14 of a housing longitudinal axis 16 from a first length 18 to a second length 20. By way of example only, the first length 18 has a generally cylindrical configuration and the second length 20 has a generally parallelepiped configuration. The insulative housing of the present invention comprises a first passage which is constructed and arranged to contain at least a portion of a contact and a section of a coaxial cable which includes a conventional ground wire braid and a central conductor, the cable being adapted to be electrically connected to the contact. For example, as best illustrated in FIG. 2, insulative housing 10 comprises a first passage 22 which is constructed and arranged to contain at least a portion 24 of contact 26 and a section 28 of cable 30. Cable 30 includes a ground wire braid 32 and a central conductor 34. The central conductor 34 may be electrically and mechanically connected to the contact 26 in a conventional mariner such as by welding or crimping. In the embodiment illustrated in FIG. 2, the central conductor 34 is crimped to contact 26 as described in more detail hereinafter. Although contact 26 is depicted as a male contact comprising a conventional prong 36 and conductor crimping tabs 38, a female contact may be substituted for the male contact, if desired. For example, male contact 26 may be replaced with the female contact 40 depicted in FIG. 3, female contact 40 comprising a conventional ferrule 42 and conductor crimping tabs 44. In such an embodiment, the first passage 22 may be constructed and arranged to contain the entire length of the female contact 40 such that the end 46 of the female contact is adjacent the end 48 of the insulative housing 10.

In the embodiment illustrated in FIGS. 1 and 2, the first passage 22 is constructed and arranged to contain (a) the portion 24, which includes all of the contact 26 with the exception of the portion of the prong 36 extending from the insulative housing 10, in the first length 18 of the insulative housing 10, (b) a jacketed segment of the section 28 of cable 30 in the second length 20 of the insulative housing 10, and (c) a length of exposed conductor 34 adjacent the contact 26.

The insulative housing 10 includes at least one second passage 50 extending from an outer periphery 52 of the insulative housing to the first passage 22 such that each second passage 50 intersects passage 22. In the embodiment illustrated in FIGS. 1 and 2, each second passage 50 is positioned at the second length 20. Without limitation, in the embodiment illustrated in FIGS. 1 and 2, there are two second passages 50 which are spaced from each other in a circumferential direction 54 in relation to the housing longitudinal axis 16 about ninety degrees.

The insulative housing of the present invention comprises a channel in its outer periphery. In the embodiment illustrated in FIG. 1, such channel is located at the first length 18 of the insulative housing 10. In particular, in the embodiment illustrated in FIGS. 1 and 4, a channel 56 is provided in the outer periphery of the insulative housing 10. Channel 56 includes a base 58, a first recessed wall 60 extending from one edge 62 of the base and configured to provide a first recess 64, and an opposing second recessed wall 66 extending from an opposite edge 68 of the base and configured to provide an opposite second recess 70.

The conductive ground shell 12 of the connector assembly of the present invention extends in a direction 72 of a ground shell longitudinal axis 74 from a first end 76 to a second end 78. The conductive ground shell 12 comprises at least one leg 80 insertable into a second passage 50 and being bendable towards and away from the first passage 22 for engaging and disengaging the ground wire braid 32, respectively. In the embodiment illustrated in FIGS. 1 and 2, there are two legs 80 each of which is insertable into a respective second passage 50 and bendable towards and away from the first passage 22 for engaging and disengaging the ground wire braid 32, respectively, as described hereinafter. The two legs 80 are spaced from each other in a circumferential direction 82 in relation to the ground shell longitudinal axis 74 about ninety degrees. The two legs 80 are located at the first end 76 of the conductive ground shell 12.

The conductive ground shell of the present invention also includes a region constructed and arranged to mate with the peripheral channel in the insulative housing of the present invention. For example, in the embodiment of FIGS. 1 and 4 the conductive ground shell 12 includes a region 84 which mates with the channel 56 of the insulative housing 10. Region 84 is located at the second end 78 of the conductive ground shell 12. Region 84 comprises a first elongated flange 86, and an opposite second elongated flange 88, constructed and arranged to extend into and mate with the first recess 64 and the opposite second recess 70 of channel 56.

In the embodiment of FIGS. 1 and 2, the insulative housing 10 comprises a third passage 90 which extends from the outer periphery of the insulative housing to the first passage 22 at the first length 18 of the insulative housing. Third passage 90 provides access to the contact 26 and cable 30 when they are inserted into the first passage 22 as described hereinafter.

Figure 4:
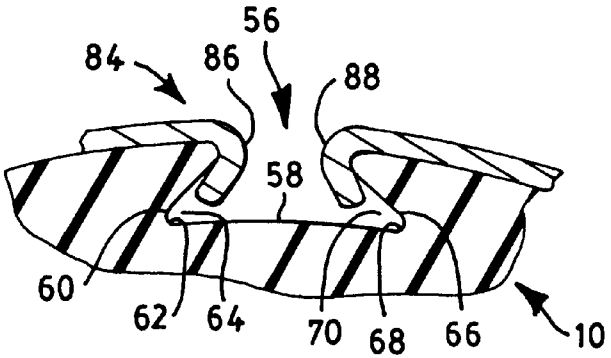
FIG. 4 is a cross section of the assembled connector assembly of FIG. 1 taken along lines 3—3.
Figure 5:
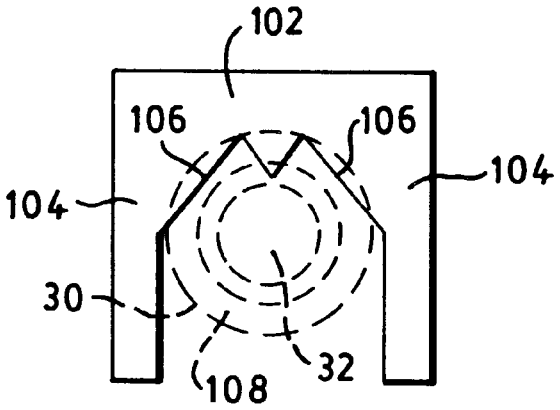
FIG. 5 is a diagrammatic illustration of a leg of the connector assembly of the present invention electrically contacting a ground wire braid of a coaxial cable.

The operation of the connector assembly of the present invention will now be described with reference to FIGS. 1, 2 and 4. An end 92 of the cable 30 is trimmed in a conventional manner to expose a length of the central conductor 34. Contact 26 is inserted into the first passage 22 at end 48 of the insulative housing 10 to the extent that the conductor crimping tabs 38 are visible through the third opening 90, and the prong 36 extends outwardly from the insulative housing as illustrated in FIG. 2. The end 92 of the cable 30 is inserted into the first recess 22 at end 94 of the insulative housing to the extent that the central conductor 34 overlaps the contact 26 in the vicinity of the conductor crimping tabs 38 and is visible through the third opening 90. The contact 26 is electrically and mechanically connected to the cable 30 by crimping the conductor crimping tabs 38 into engagement with the central conductor 34. To this end, a conventional crimping tool may be inserted into the third opening 90. The third opening 90 may extend completely through the insulative housing 10 such as at the reduced opening 96 to further facilitate connection of the central conductor 34 to the contact 26. The conductive ground shell 12 is mated with the insulative housing 10 by inserting the prong 36 and the end 48 of the insulative housing into the conductive ground shell at end 76 until the flange 98 at end 78 of the conductive ground shell 12 abuts end 48 of the insulative housing. Insertion of the insulative housing 10 into the conductive ground shell 12 is facilitated in the embodiment illustrated in FIG. 1 by aligning the channel 56 with the region 84 and mating the region 84 and channel 56 while sliding the insulative housing into the conductive ground shell. The conductive ground shell 12 is dimensioned such that when the flange 98 abuts end 48, the legs 80 will be positioned for insertion into respective second passages 50. To this end, the legs 80 are bent at 100 causing the length 102 of each leg 80 to be inserted into a respective second passage 50 until each leg portion 104 engages the cable 30. With reference to FIG. 5, each leg portion 104 is constructed and arranged to provide cutting surfaces 106 which penetrate the jacket 108 of the cable 30 and effect an electrical connection with the ground wire braid 32 of the cable.

The insulative housing of the present invention may allow for a less obtrusive mating with the conductive ground shell. For example, in the embodiment illustrated in FIGS. 1 and 2, the insulative housing 10 includes recessed areas 110 adjacent each second passage 50. The height of each recessed area 110 is substantially equal to the thickness of the conductive material from which the conductive ground shell 12 is fabricated so that the height of each recessed area 110 will be substantially equal to the thickness of the length 112 of each leg 80. In this manner, each leg 80 may be dimensioned such that upon being fully inserted into a respective second passage 50 the length 112 will be level with the periphery 52 as a result of being depressed into a recessed area 110 during the bending operation.

In order to hold the contact 26 in place once inserted into the first passage 22 of the insulative housing 10, the third passage 90 may be constructed and arranged to provide a wall 114 which may be engaged by a portion of the contact. For example, as illustrated in FIG. 2, after the contact 26 has been inserted into the first passage 22, one or more tabs 116 of the contact 26 may be bent to engage wall 114 to prevent movement of the contact 26 in the direction 14 of axis 16 away from the second length 20 of the insulative housing 10.

To facilitate insertion of the contact 26 into the first passage 22 of the insulative housing 10, the insulative housing and contact may be constructed and arranged to mate with each other. For example, in the embodiment illustrated in FIG. 1, the insulative housing 10 comprises oppositely facing grooves 118 at the first length 18 adjacent the first passage 22 of the insulative housing. Similarly, the contact 22 may include oppositely extending tabs 120 which extend from the contact and mate with grooves 118 when the contact is inserted into the passage 22.

Figure 6:
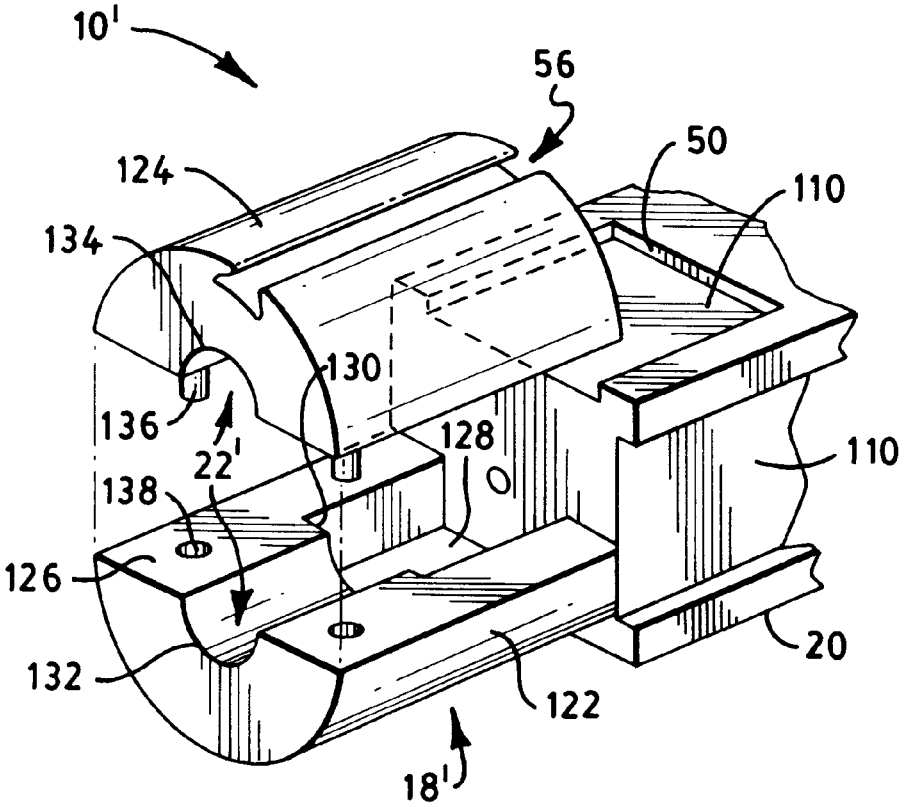
FIG. 6 is an exploded view of another embodiment of a insulative housing of the connector assembly of the present invention.

In an alternative embodiment depicted in FIG. 6, an insulative housing 10' may replace insulative housing 10 of FIG. 1. Insulative housing 10' is identical to insulative housing 10, like reference numerals representing like elements, with the exception that a first length 18' comprises two mating components including a first component 122 which is integral with the second length 20 of the insulative housing, and a second component 124 constructed and arranged to be attached to the first component 122 to provide the first passage 22' at an interface 126 between the first component 122 and second component 124. In such embodiment, the connector assembly of the present invention is assembled in the same manner as the embodiment of FIG. 1 with the exception that the contact 26 is placed within the opening 128 of the first component 122 such that the prong 36 extends from the insulative housing 10' and the tabs 116, which are unbent in this embodiment as illustrated in phantom lines in FIG. 1, engage the wall 130. In such embodiment, after the contact 26 is inserted in place the central conductor 34 is then electrically and mechanically connected to the tabs 38 of the contact 26. Upon completion of such connection, the second component 124 may be attached to the first component 122 to sandwich the contact 26 and central conductor 34 between the portion 132 of the passage 22' of the first component 122 and the portion 134 of the passage 22' of the second component 124. Without limitation, the first component 122 and second component 124 may be attached together by mating snap-like fasteners 136 and 138.

Fabrication of the connector assembly of the present invention may be accomplished using conventional procedures. For example, the contacts 26, 40 and conductive ground shell 12 may be stamped from a metal sheet and then rolled and/or bent as required to form the desired configuration. The insulative housing 10 may be molded from a plastic material.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A connector assembly, comprising:

an insulative housing extending in the direction of a housing longitudinal axis from a first length to a second length and having (a) a first passage constructed and arranged to contain at least a portion of a contact and a section of cable, comprising a ground wire braid and adapted to be connected to said contact, (b) at least one second passage extending from an outer periphery of said insulative housing to said first passage; and (c) a channel in said outer periphery; and a conductive ground shell extending in the direction of a ground shell longitudinal axis from a first end to a second end and constructed and arranged to mate with said insulative housing and including at least one leg insertable into said at least one second passage and being bendable towards and away from said first passage for engaging and disengaging a ground wire braid, respectively, said conductive ground shell further including a region constructed and arranged to mate with said channel.

2. The connector assembly of claim 1 wherein said first passage is constructed and arranged to contain said at least a portion of a contact at said first length, a first jacketed segment of said section of cable at said second length, and an exposed central conductor of said section of cable adjacent said contact; wherein said at least one second passage is located at said second length and said channel is located at said first length; and wherein said at least one leg is located at said first end and said region is located at said second end.

3. The connector assembly of claim 1 wherein said at least one second passage includes two second passages and further wherein said at least one leg includes two legs, each leg being insertable into a respective second passage and being bendable towards and away from said first passage for engaging and disengaging a ground wire braid, respectively.

4. The connector assembly of claim 1 wherein said channel comprises a base, a first recessed wall extending from one edge of said base and configured to provide a first recess, and an opposing second recessed wall extending from an opposite edge of said base and configured to provide an opposite second recess, and further wherein said region comprises a first flange and an opposite second flange constructed and arranged to extend into and mate with said first recess and said opposite second recess, respectively.

5. The connector assembly of claim 2 wherein said insulative housing further comprises a third passage extending from said outer periphery of said insulative housing to said first passage at said first length.

6. The connector assembly of claim 3 wherein said two second passages are spaced from each other circumferentially in relation to said housing longitudinal axis about ninety degrees, and further wherein said two legs are spaced from each other circumferentially in relation to said conductive ground shell longitudinal axis about ninety degrees.

7. The connector assembly of claim 1 further including a recessed area adjacent said at least one second passage and wherein a height of said recessed area is substantially equal to a thickness of said at least one leg.

8. The connector assembly of claim 5 wherein said third passage comprises an abutment constructed and arranged to engage a contact contained in said first passage to pre vent movement of said contact in the direction of said housing longitudinal axis away from said second length.

9. The connector assembly of claim 1 wherein said insulative housing comprises oppositely facing grooves at said first length adjacent said first passage, said oppositely facing grooves being constructed and arranged to be mateable with oppositely extending tabs extending from said contact.

10. The connector assembly of claim 2 wherein said first length of said insulative housing comprises a first component integral with said second length of said insulative housing, and a second component constructed and arranged to be attached to said first component to provide said first passage at an interface between said first component and said second component.

* * * * *